US005295878A

United States Patent [19]

Guidry

[11] Patent Number: 5,295,878

[45] Date of Patent: Mar. 22, 1994

[54] MUD BUG

[76] Inventor: Ben Guidry, Rt. 5, Box 3445, Sulphur, La. 70663

[21] Appl. No.: 842,537

[22] Filed: Feb. 27, 1992

[51] Int. Cl.[5] ..... B63H 16/20

[52] U.S. Cl. ..... 440/28; 440/30; 440/62

[58] Field of Search ..... 440/26, 27, 28, 29, 440/30, 31, 32, 55, 56, 61, 65, 62, 21, 22, 23, 24, 25

[56] References Cited

U.S. PATENT DOCUMENTS

| | | | |
|---|---|---|---|
| 1,618,180 | 2/1927 | Ford | 440/31 |
| 1,667,912 | 5/1928 | Vlahon | 441/40 |
| 3,016,869 | 1/1962 | Anderson et al. | 440/56 |
| 3,052,204 | 9/1962 | Scivally | 440/62 |
| 3,099,242 | 7/1963 | Queen | 440/65 |
| 3,166,040 | 1/1965 | Armantrout et al. | 440/56 |
| 3,244,136 | 4/1966 | Yarbrough | 440/28 |
| 3,377,976 | 4/1968 | Gustine | 440/28 |
| 4,188,719 | 2/1980 | Hoff | 30/122 |
| 4,324,551 | 4/1982 | Gurries | 440/62 |
| 4,604,067 | 11/1984 | Roberts | 440/49 |
| 4,891,024 | 1/1990 | Benjamin | 440/26 |

FOREIGN PATENT DOCUMENTS

| | | | |
|---|---|---|---|
| 2423145 | 11/1975 | Fed. Rep. of Germany | 440/31 |
| 8500552 | 12/1985 | Netherlands | 440/31 |

*Primary Examiner*—Michael S. Huppert
*Assistant Examiner*—Thomas J. Brahan

[57] ABSTRACT

Mud bug, a portable system for propulsion of small boats consisting basically of a carrying frame (10) housing controls for forward and reverse speed, steering, and tilt of a remote mounted outdrive assembly. Control is accomplished through flexible sheathed cables. Adjustable tension provided by (66) and (74) allows the outdrive to tilt when in forward operation if underwater obstruction is encountered, and also provides lift and lock to tilt the outdrive up and free of the water. When operating in reverse, (62) will automatically lock the outdrive down. The carrying frame provides a boom (19) and attachment for mounting the outdrive on boats with unavailable motor mounting. The carrying frame also provides outriggers (14) for stability and a lower rear seat mount. Local adjustment of both the outdrive height and tilt are controlled by the single fastener (54) in the adjustment clamp (53) on the outdrive mount.

2 Claims, 6 Drawing Sheets

MUD BUG

BACKGROUND

This invention relates to marine propulsion, specifically a pedal operated device.

DISCUSSION OF PRIOR ART

The outboard motor is, and will continue to be the choice of most small boat operators for propulsion.

Paddles and oars are the common tools for operator powered propulsion of small boats. Operator powered options are provided by prior art which does not conflict with this invention. Prior art referenced in this application:

| | | |
|---|---|---|
| U.S. Pat. No. | 4,188,719 | Hoff |
| U.S. Pat. No. | 4,604,067 | Roberts |

The pedal operated equipment presented in prior patents is either integrated with the design of the boat, is not versatile enough to adapt to differing boat configurations, and will not function well in reverse. They have mechanical reliance on long exposed drive shafts and control rods which hurt their portability and aesthetics. The operator is limited to where he (or she) must sit, in cases facing the rear of the boat creating a potential safety problem.

The present invention provides ready portability and versatility toward application. Remote controls featured are superior even to those of many outboard motors: Variable forward and reverse speed control, remote steering, and remote tilt and lock of the outdrive unit. The outdrive unit features: an automatic tilt on encounter with an under water obstruction, an automatic down lock when operating in reverse, and has a single fastener to locally set both height and tilt. Heel supports on the pedals permit the operator to rest his legs in place, and the pedal drive may be used to drive a compressor suitable for airing up inflatables. Even multiple pedal units may be used on the same boat.

OBJECTS AND ADVANTAGES

The main object of this invention is to provide a pedal powered marine propulsion system that is convenient to use in sports, recreation, competition, or just fun. This apparatus is non-polluting, and will satisfy an environmentally sensitive society.

The present invention exhibits advantage over most prior art in its portability. It has a carrying frame which houses all remote function controls. These controls are mechanically connected to the outdrive through three flexible sheathed cables.

The present invention exhibits advantage over most prior art in its versatility. The outdrive can be mounted wherever a troll motor can be mounted. Equipment with the present invention will permit use of the outdrive on canoes and inflatable boats. It is also versatile in that the operator may select where on the boat he wishes to place the controls, and could achieve a trim correction of the boat by doing so. Further versatility advantage can be achieved by using multiple units on the same boat.

The present invention exhibits advantage over most prior art in its convenient remote control features. The operator can control speed forward and reverse with the pedals, he can control turn and direction with the adjustable steering handle, and by folding away the adjustable steering handle, he will force the outdrive to tilt and lock out of the water until ready for use again.

The present invention exhibits advantages over most prior art in the functioning features of the outdrive assembly. The outdrive will tilt from its upper hinge (tilt cradle hinge pin) if an underwater obstruction is contacted. This feature is automatic with control tension to restrain this tilt being adjustable. Also, this outdrive will automatically lock down when operating in reverse to hold the propeller in the water. This outdrive also has a single local fastener to set both height and tilt.

The present invention exhibits advantage over prior art in the use of heel rest on the pedals. This feature permits the operator to rest his legs without his feet slipping off the pedals.

The present invention exhibits advantage over prior art in its ability to drive an air compressor.

DRAWING FIGURES

REFERENCE NUMERALS IN DRAWINGS

Figure 1:
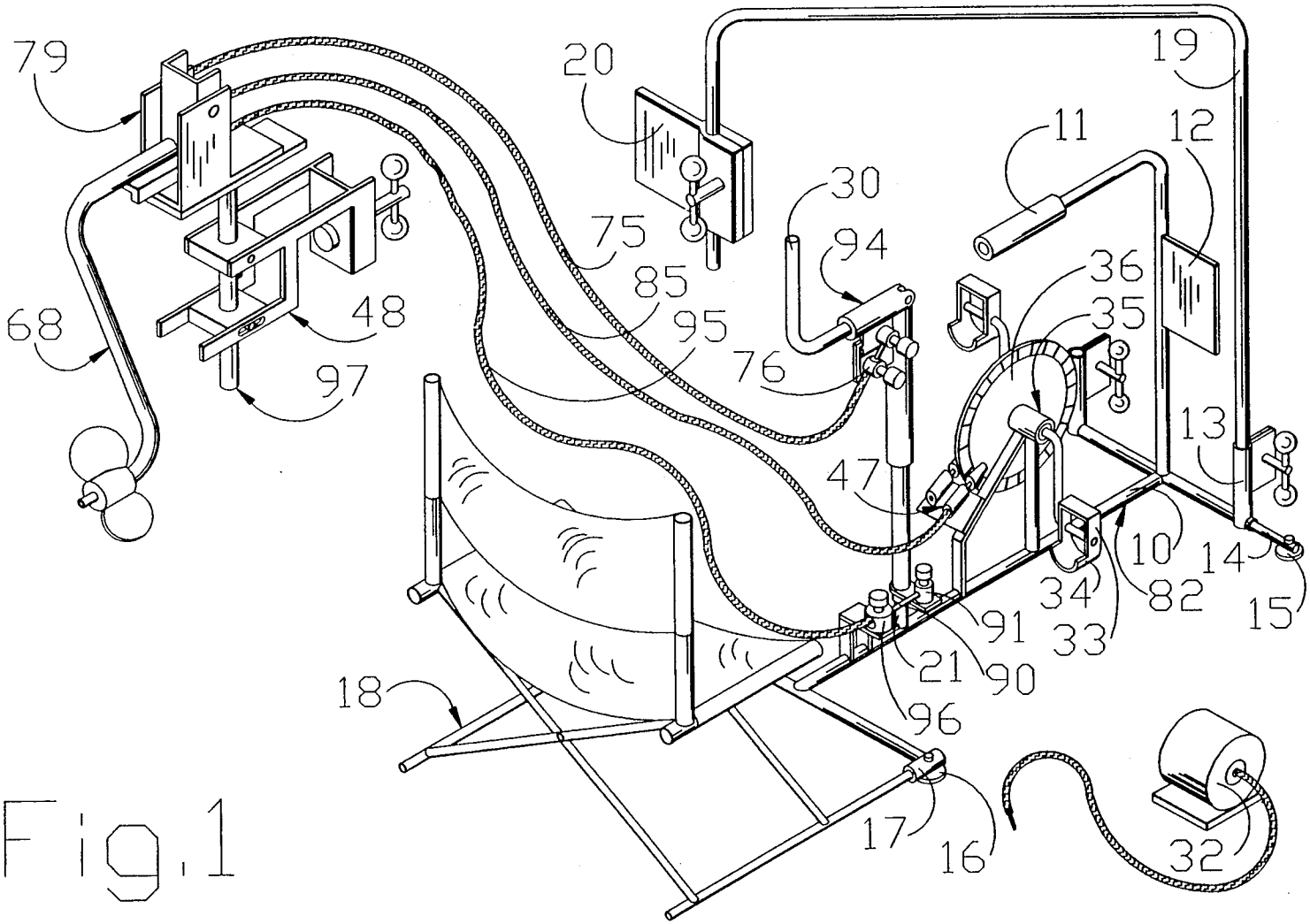
FIG. 1 is a perspective view of the frame and attachments.
Figure 2B:
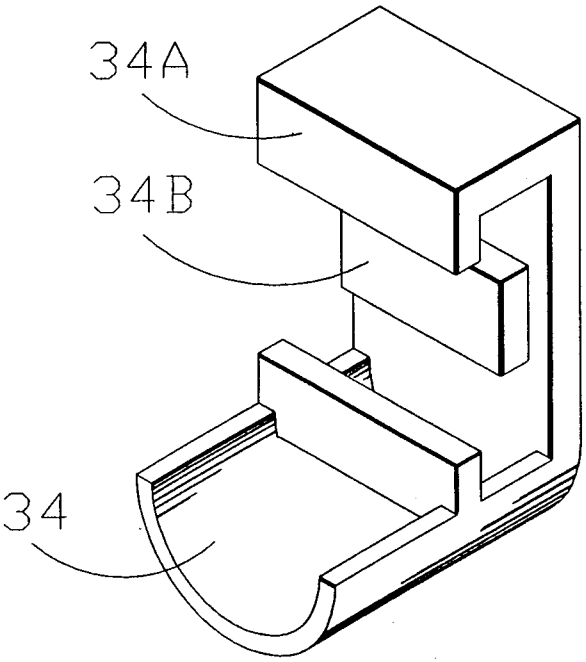
FIG. 2B is a perspective view of the pedal heel rest.
Figure 2A:
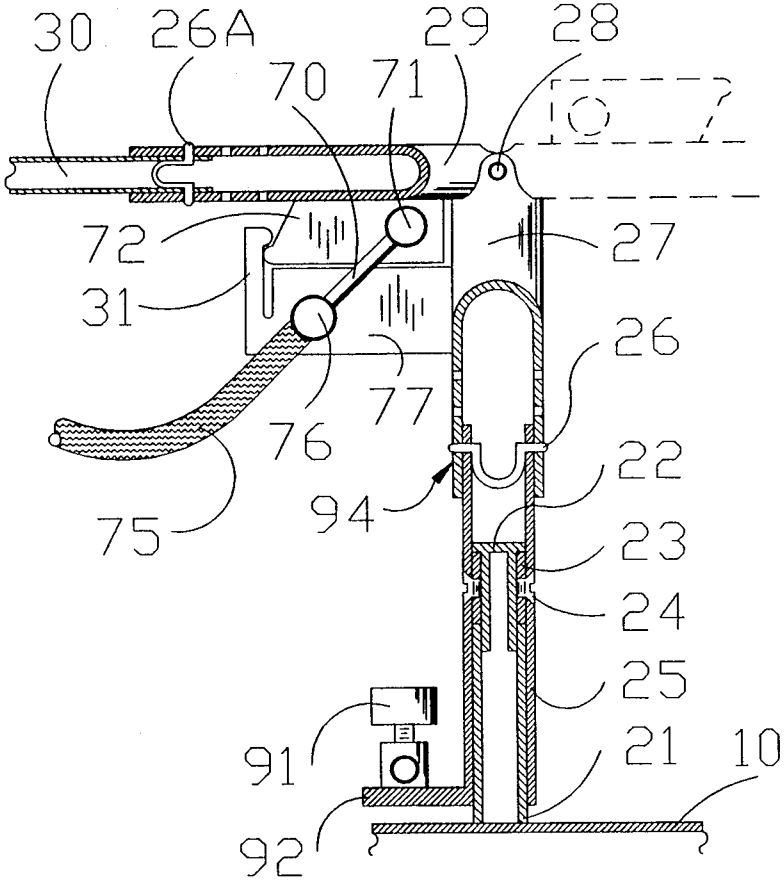
FIG. 2A is a part sectional side view, and broken line alternate position of the steering handle assembly.

| Item | Name | Drawing |
|---|---|---|
| 10 | frame | FIG. 1 |
| 11 | carrying handle | FIG. 1 |
| 12 | outdrive storage bracket | FIG. 1 |
| 13 | boom bracket with clamp and outrigger housing | FIG. 1 |
| 14 | adjustable outrigger | FIG. 1 |
| 15 | front mounting pad with retainer bolt | FIG. 1 |
| 16 | rear mounting pad with retainer bolt | FIG. 1 |
| 17 | seat mount | FIG. 1 |
| 18 | adjustable folding seat | FIG. 1 |
| 19 | adjustable boom | FIG. 1 |
| 20 | outdrive mounting bracket with adjustment clamp | FIG. 1 |
| 21 | steering mount | FIG. 1 |
| 22 | bushing pin | FIG. 2A |
| 23 | bushing | FIG. 2A |
| 24 | retainer screw | FIG. 2A |
| 25 | vertical carrier | FIG. 2A |
| 26 | adjustment lock | FIG. 2A |
| 26A | adjustment lock | FIG. 2A |
| 27 | adjustable vertical tube | FIG. 2A |
| 28 | hinge pin | FIG. 2A |
| 29 | horizontal tube | FIG. 2A |
| 30 | adjustable steering handle | FIG. 2A |
| 31 | down lock | FIG. 2A |
| 32 | air compressor with sheathed drive cable | FIG. 1 |
| 33 | pedal and crank | FIG. 1 |

-continued

Figure 3:
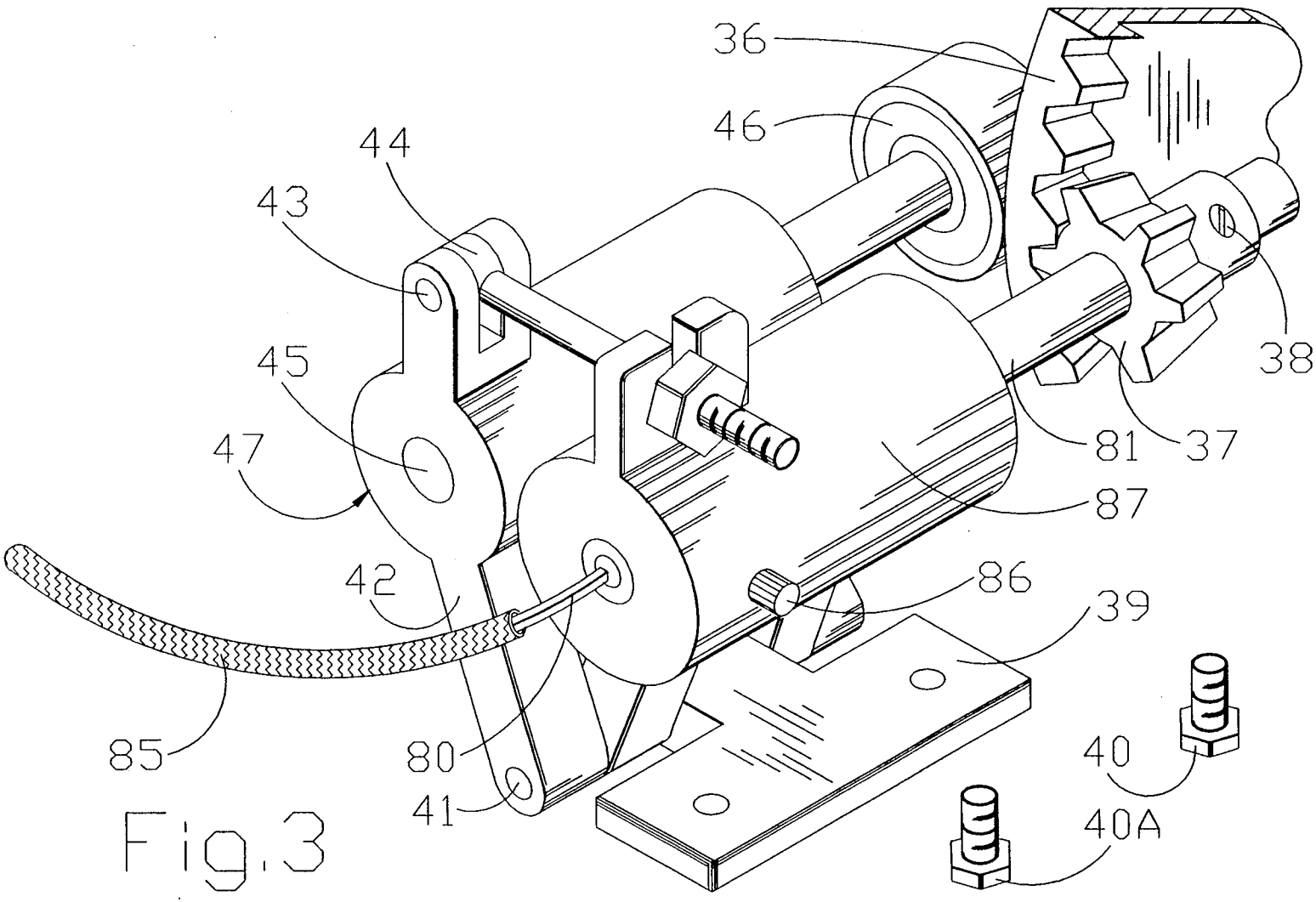
FIG. 3 is a perspective view of the driven bevel gear assembly.
Figure 4C:
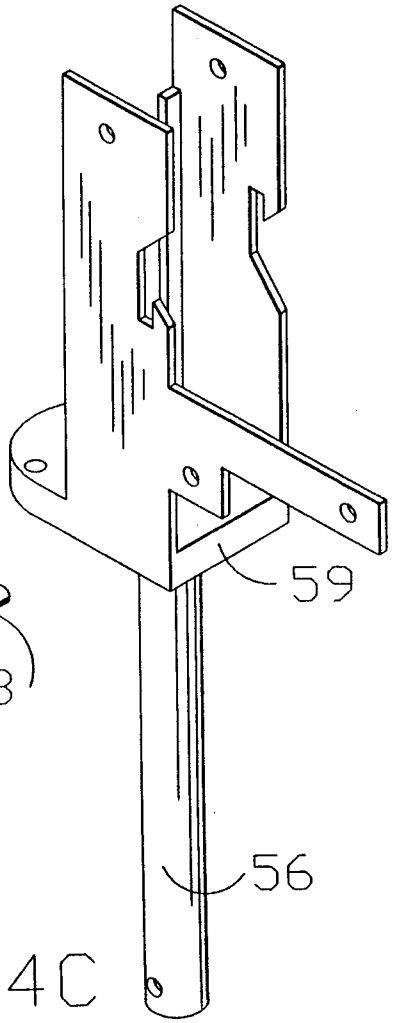
FIG. 4C is a perspective view of the steering tube and tilt housing.
Figure 4B:
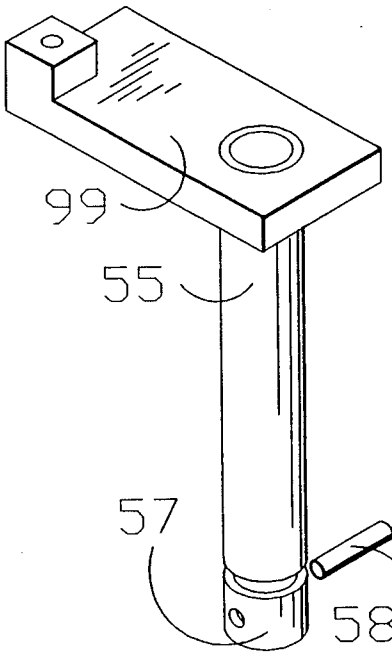
FIG. 4B is a perspective view of the adjustment tube and securing mechanism for the steering tube shown in FIG. 4C.
Figure 4A:
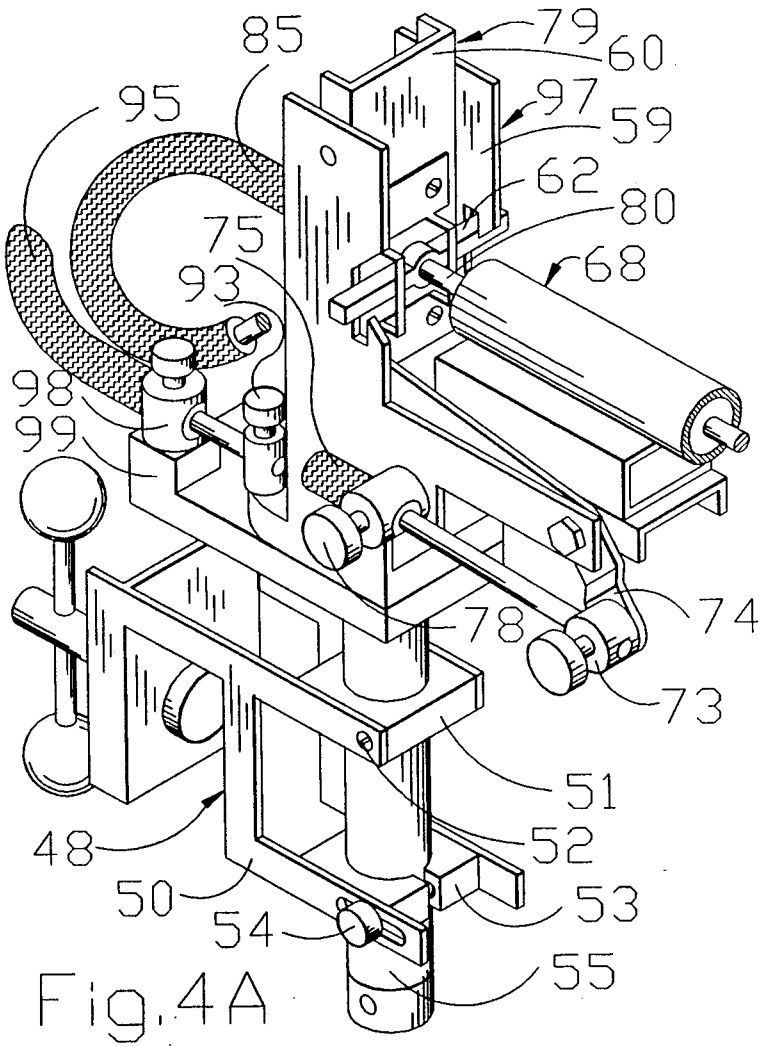
FIG. 4A is a perspective view of the outdrive assembly.
Figure 5B:
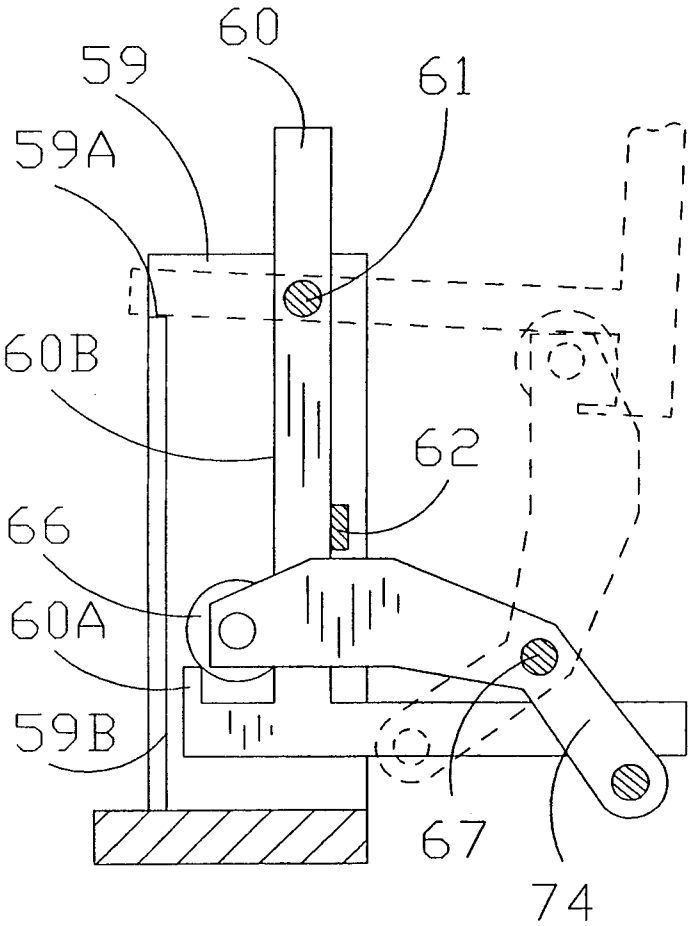
FIG. 5B is a sectioned side view of the tilt arm with broken lines showing the alternate position of the tilt cradle.
Figure 5A:
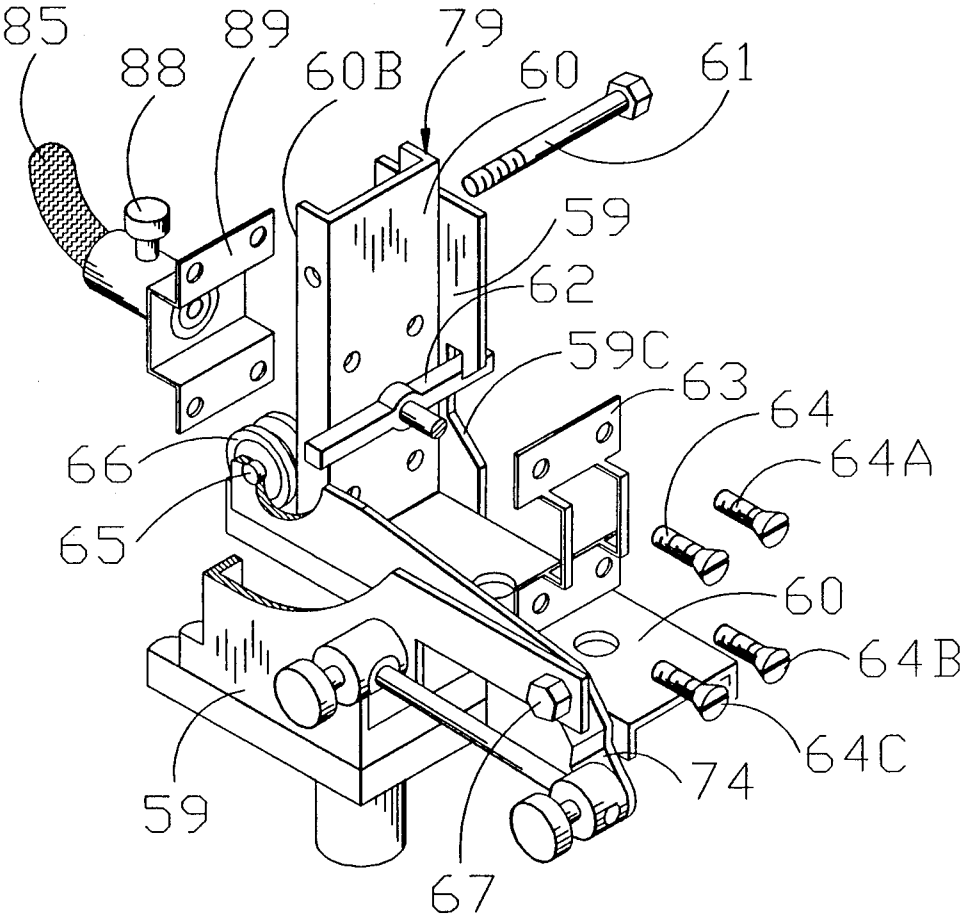
FIG. 5A is a sectioned and exploded perspective view of the tilt housing.
Figure 6B:
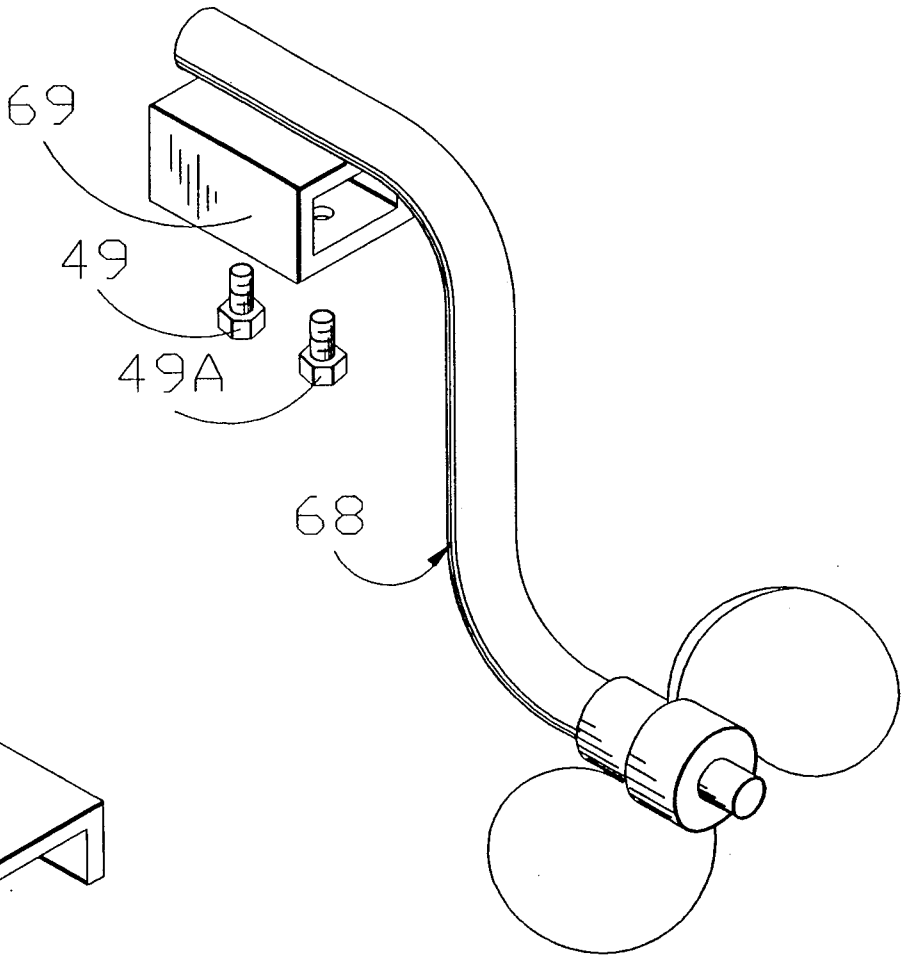
FIG. 6B is a perspective view of the foot, foot mount, and the foot with propeller assembly.
Figure 6A:
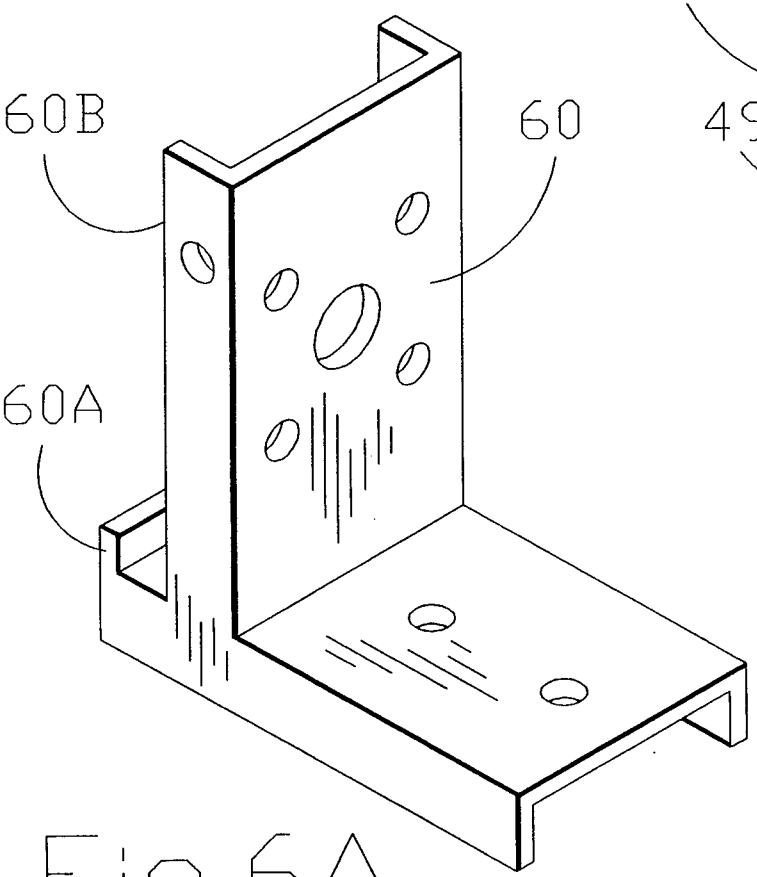
FIG. 6A is a perspective view of the tilt cradle without attachments.

| Item | Name | Drawing |
|---|---|---|
| 34 | heel rest | FIG. 2B |
| 34A | clip over pedal | FIG. 2B |
| 34B | centralizer | FIG. 2B |
| 35 | pedal bearing assembly with mount brackets | FIG. 1 |
| 36 | driver bevel gear | FIG. 3 |
| 37 | driven bevel gear | FIG. 3 |
| 38 | bevel gear set screw | FIG. 3 |
| 39 | hinge plate | FIG. 3 |
| 40 | hinge plate mounting bolt | FIG. 3 |
| 40A | hinge plate mounting bolt | FIG. 3 |
| 41 | bearing housing hinge pin | FIG. 3 |
| 42 | idler bearing mount | FIG. 3 |
| 43 | eye bolt hinge pin | FIG. 3 |
| 44 | eye bolt and nut | FIG. 3 |
| 45 | idler bearing mounting stud with nut | FIG. 3 |
| 46 | idler bearing | FIG. 3 |
| 47 | driven bevel gear assembly | FIG. 3 |
| 48 | outdrive mounting assembly | FIG. 4A |
| 49 | foot mount bolt | FIG. 6B |
| 49A | foot mount bolt | FIG. 6B |
| 50 | outdrive frame with screw clamp | FIG. 4A |
| 51 | tube guide | FIG. 4A |
| 52 | tube guide hinge pin | FIG. 4A |
| 53 | tube guide/clamp | FIG. 4A |
| 54 | tube guide pin and fastener | FIG. 4A |
| 55 | adjustment tube | FIG. 4B |
| 56 | steering tube | FIG. 4C |
| 57 | steering tube cap | FIG. 4B |
| 58 | retainer pin | FIG. 4B |
| 59 | tilt housing | FIG. 4C |
| 59A | tilt limit | FIG. 5B |
| 59B | forward thrust contact | FIG. 5B |
| 59C | reverse lock slot | FIG. 5A |
| 60 | tilt cradle | FIG. 6A |
| 60A | tilt cradle transverse flange | FIG. 6A |
| 60B | tilt cradle vertical flange | FIG. 6A |
| 61 | tilt cradle hinge pin | FIG. 5A |
| 62 | reverse lock pin | FIG. 5A |
| 63 | lock pin retainer | FIG. 5A |
| 64 | lock pin retainer bolt | FIG. 5A |
| 64A | lock pin retainer bolt | FIG. 5A |
| 64B | lock pin retainer bolt | FIG. 5A |
| 64C | lock pin retainer bolt | FIG. 5A |
| 65 | roller mounting stud with nut | FIG. 5A |
| 66 | grooved roller | FIG. 5A |
| 67 | tilt arm hinge stud with nut | FIG. 5A |
| 68 | foot with propeller assembly | FIG. 6B |
| 69 | foot mount | FIG. 6B |
| 70 | tilt cable | FIG. 2A |
| 71 | tilt cable retainer with screw inboard | FIG. 2A |
| 72 | tilt cable retainer mount inboard | FIG. 2A |
| 73 | tilt cable retainer with screw outboard | FIG. 4A |
| 74 | tilt arm | FIG. 4A |
| 75 | tilt cable sheath | FIG. 4A |
| 76 | tilt cable sheath retainer with screw inboard | FIG. 2A |
| 77 | tilt cable sheath retainer mount inboard | FIG. 2A |
| 78 | tilt cable sheath retainer with screw outboard | FIG. 4A |
| 79 | tilt assembly | FIG. 5A |
| 80 | drive cable | FIG. 3 |
| 81 | drive shaft and cable coupler | FIG. 3 |
| 82 | frame assembly | FIG. 1 |
| 83 | (not used) | |
| 84 | (not used) | |
| 85 | drive cable sheath | FIG. 3 |
| 86 | drive cable sheath retainer screw inboard | FIG. 3 |
| 87 | driven gear bearing housing | FIG. 3 |
| 88 | drive cable sheath retainer with screw outboard | FIG. 5A |
| 89 | drive cable sheath retainer mount outboard | FIG. 5A |
| 90 | steering cable | FIG. 1 |
| 91 | steering cable retainer with screw inboard | FIG. 1 |
| 92 | steering cable retainer mount inboard | FIG. 1 |
| 93 | steering cable retainer with screw outboard | FIG. 1 |
| 94 | steering handle assembly | FIG. 2A |
| 95 | steering cable sheath | FIG. 1 |
| 96 | steering cable sheath retainer with screw inboard | FIG. 1 |
| 97 | outdrive steering assembly | FIG. 4A |
| 98 | steering cable sheath retainer with screw outboard | FIG. 4A |

-continued

| Item | Name | Drawing |
|---|---|---|
| 99 | steering cable sheath retainer mount outboard | FIG. 4B |

DESCRIPTION

FIG. 1 shows the overall assembly and 82—frame assembly, which is a welded fabrication consisting of 10—frame, which is the mounting for 11—carrying handle, 12—outdrive storage bracket, 13—boom bracket with clamp and outrigger housing, clamp using threaded vice action (identical both sides), 17—seat mount (identical both sides), 21—steering mount, 96—steering cable sheath retainer with screw inboard, 35—pedal bearing assembly with mounting brackets, 47—driven bevel gear assembly bolted at 35—pedal bearing assembly with mounting brackets by 40, and 40A—hinge plate mounting bolts, and 14—adjustable outrigger telescopes into 13—boom bracket with clamp and outrigger housing, being secured with attachment not shown being identical to FIG. 2A 26—adjustment lock with outriggers identical on both sides of the frame.

Also in FIG. 1 is 15—front mounting pad with retainer bolt (identical both sides), is removably secured to 14—adjustable outrigger, and 16—rear mounting pad with retainer bolt (identical both sides) is removably secured to 17—seat mount and also secures 18—adjustable folding seat. Items 15—front mounting pad with retainer bolt, and 16—rear mounting pad with retainer bolt may be secured to a boat using screws, glue, or a velcro product. Item 19—adjustable boom supports a remote mount location for the outdrive 20—outdrive mounting bracket with adjustment clamp, adjustment clamp using a threaded vice action on the outer boom for position lock. Item 34—heel rest is attached to 33—pedal and crank, which is attached through 35—pedal bearing assembly with mounting brackets, and is typical for bicycle applications. Item 32—air compressor with sheathed drive cable for alternate attachment to 87—driven gear bearing housing will secure with 86—drive cable sheath retainer screw inboard.

FIG. 2A shows the steering handle assembly—94. Items 91—steering cable retainer with screw inboard, and 92—steering cable retainer mount inboard are shown rotated 90 degrees for illustration only. Item 21—steering mount, is attached at the bottom to 10—frame, and at the top to 22—bushing pin by spot weld or press. Item 23—bushing is free to rotate between 21—steering mount and 22—bushing pin which secures same. Item 25—vertical carrier is secured to 23—bushing by 24—retainer screw (identical both sides). Item 27—adjustable vertical tube telescopes over 25—vertical carrier, and is secured by 26—adjustment lock. Item 27—adjustable vertical tube is secured to 29—horizontal tube with 28—hinge pin. Item 30—adjustable steering handle telescopes into 29—horizontal tube, and is secured by 26A—adjustment lock.

FIG. 2B shows the pedal heel rest—34, which is made of a flexible material to allow 34A—clip over pedal to fasten over the pedal without disassembly, and 34B—centralizer fits between pedal components to prevent side to side movement.

FIG. 3 shows 47—driven bevel gear assembly, which is bolted at 39—hinge plate, to 35—pedal bearing assembly with mount brackets. Item 41—bearing housing hinge pin connects 39—hinge plate with 42—idler bearing mount, and 87—driven gear bearing housing with similar bearing configuration as prior art S. J. Hoff—U.S. Pat. No. 4,188,719 (1980) FIG. 9. This present invention 45—idler bearing mounting stud with nut secures 46—idler bearing. Item 43—eye bolt hinge pin secures 44—eye bolt and nut which regulates the tension of 46—idler bearing and 37—driven bevel gear on 36—driver bevel gear. Item 38—bevel gear set screw secures 37—driven bevel gear to 81—drive shaft and cable coupler. This configuration may be changed in consideration of a faster method of replacing the driven bevel gear as operating conditions may require a different size, and a gear that would slip on and self lock could be worthwhile.

FIG. 4A Assembled outdrive, accompanied by FIG. 4B, and FIG. 4C outdrive components. Assembly 48—outdrive mounting assembly consist of 50—outdrive frame with screw clamp, having a threaded fastener opposite the outdrive to provide a vice type action on the fixture on which the outdrive is mounted. Item 50—outdrive frame with screw clamp provides mounting for 51—tube guide, which is secured by 52—tube guide hinge pin, and for 53—tube guide/clamp, which is secured by 54—tube guide pin and fastener. Item 55—adjustment tube slides through 51—tube guide and is secured by 53—tube guide/clamp. Item 97—outdrive steering assembly is composed of 99—steering cable sheath retainer mount outboard, attached to the top of 55—adjustment tube by thread or weld, with 56—steering tube telescoping into same, and being secured in place by 57—steering tube cap, and 58—retainer pin. Item 59—tilt housing is secured to the top of 56—steering tube by thread or weld. Item 79—tilt assembly is better illustrated in FIG. 5A.

FIG. 5A Showing 79—tilt assembly comprising of 59—tilt housing which provides mounting for 60—tilt cradle at 61—tilt cradle hinge pin, and 74—tilt arm at 67—tilt arm hinge stud with nut. Item 59C—reverse lock slot (each side) secures 62—reverse lock pin when the lock pin is rotated to coincide with reverse rotation of the cable or shaft passing through it, and when the pin is rotated in the other direction it is not restrained. Item 66—grooved roller is attached to 74—tilt arm by 65—roller mounting stud with nut. Item 63—lock pin retainer restricts the motion of 62—reverse lock pin to rotational only, and is bolted to 89—drive cable sheath retainer mount outboard through 60—tilt cradle with 64, 64A, 64B, and 64C—lock pin retainer bolts.

FIG. 6A showing 60—tilt cradle stripped for a clear view of 60A—tilt cradle transverse flange, and 60B—tilt cradle vertical flange, also the bolt holes are visible where attachments are mounted as described herein.

FIG. 6B showing 68—foot with propeller assembly which is secured by welding to 69—foot mount, which in turn is secured to 60—tilt cradle with 49, and 49A—foot mount bolts. The presented configuration is similar to prior art Roberts—U.S. Pat. No. 4,604,067 FIG. 1 items 14, 16, and FIG. 4. Present invention may use differing arrangements, even a bevel geared foot with propeller, as the easy replacement of this assembly is a design feature.

Tilt control: FIG. 2A 29—horizontal tube is welded to 72—tilt cable retainer mount inboard, which provides mounting for 71—tilt cable retainer with screw inboard, and is secured through a drill hole by a pin which is not shown, and which allows it to rotate when 29—horizontal tube is pushed forward and back. Item 71—tilt cable retainer with screw inboard secures 70—tilt cable by tightening the screw into the side of a drilled passage for the tilt cable, a set screw action. The other end of 70—tilt cable is attached FIG. 4A to 73—tilt cable retainer with screw outboard (and is similar to 71—tilt cable retainer with screw inboard), which is attached to 74—tilt arm. The tilt cable passes through 75—tilt cable sheath. FIG. 2A 27—adjustable vertical tube is attached by welding to 77—tilt cable sheath retainer mount inboard, which provides mounting for 76—tilt cable sheath retainer with screw inboard (and is similar to 71—tilt cable retainer with screw inboard), which secures 75—tilt cable sheath on inboard end. Item 31—down lock mounts by welding to 77—tilt cable sheath retainer mount inboard, and when 29—horizontal tube is pulled towards the operator, it will be removably locked down by 31—down lock fastening to 72—tilt cable retainer mount inboard. FIG. 4A 75—tilt cable sheath is attached on the outboard end by 78—tilt cable sheath retainer with screw outboard (and is similar to 71—tilt cable retainer with screw inboard).

Steering controls: FIG. 2A 25—vertical carrier attaches by welding to 92—steering cable retainer mount inboard, which provides mounting for 91—steering cable retainer with screw inboard (and is similar to 71—tilt cable retainer with screw inboard), which in turn is attached FIG. 1 to 90—steering cable, which is attached on its other end FIG. 4A to 93—steering cable retainer with screw outboard (and is similar to 71—tilt cable retainer with screw inboard), which is attached to 59—tilt housing. The steering cable passes through 95—steering cable sheath. FIG. 1 96—steering cable sheath retainer with screw inboard (and is similar to 71—tilt cable retainer with screw inboard) is attached to 10—frame, and secures 95—steering cable sheath on its inboard end, and FIG. 4A 98—steering cable sheath retainer with screw outboard (and is similar to 71—tilt cable retainer with screw inboard) attaches to 99—steering cable sheath retainer mount outboard.

Drive control: FIG. 1 36—driver bevel gear is attached to 33—pedal and crank, and in rotation passes between FIG. 3 46—idler bearing, and 37—driven bevel gear, inducing rotation in each. Item 37—driven bevel gear transfer its rotation through 81—drive shaft and cable coupler to 80—drive cable which passes through FIG. 4A 60—tilt cradle and 62—reverse lock pin to enter and drive 68—foot with propeller assembly. Item 80—drive cable is squared on its ends similar to speedometer cable, and receptacles 81—drive shaft and cable coupler, and 68—foot with propeller assembly have squared sockets for attachment. Depending on the type of foot with propeller used on this invention, 80—drive cable may attach at the top, or may pass through 68—foot with propeller assembly, and attach at the bottom as the presented configuration illustrates. Item 80—drive cable passes through FIG. 3 85—drive cable sheath which is secured in 87—driven gear bearing housing by 86—drive cable sheath retainer screw inboard with set screw action, and is secured at its other end FIG. 5A by 88—drive cable sheath retainer with screw outboard using set screw action securing all to 89—drive cable sheath retainer mount outboard which is secured through 60—tilt cradle, to 63—lock pin retainer by 64, 64A, 64B, and 64C—lock pin retainer bolts.

Operation: The unit is transported using FIG. 1, 11—carrying handle, with the outdrive stored in 12—outdrive storage bracket. The unit is set up on a boat to suit the operator and boat features. Existing boat seat and outboard motor mount may be used, or not, as this invention provides both. For use on inflatable boats, the outdrive is removed from 12—outdrive storage bracket, and the control cables unwound from around 82—frame assembly. FIG. 1 32—air compressor with sheathed drive cable is coupled into 87—driven gear bearing housing. Pedal action can now be utilized to air up the inflatable. Item 10—frame is positioned on the boat, and 14—adjustable outriggers are positioned for optimum stability. The frame may be removably secured to the boat. Item 19—adjustable boom and 20—outdrive mounting bracket with adjustment clamp, are positioned and secured for this application, after which 48—outdrive mounting assembly is attached to same.

FIG. 2A broken lines show the alternate stored position of 30—adjustable steering handle, and FIG. 5B broken lines show the corresponding tilted and locked position of 60—tilt cradle, which is being held and secured in the raised position by 66—grooved roller, fitting as it does between 60A—tilt cradle transverse flange and 60B—tilt cradle vertical flange. Excess tilt is prevented by 59A—tilt limit by upper contact with 60—tilt cradle. Item 66—grooved roller has a groove to better accommodate 60B—tilt cradle vertical flange, which it pushes against when in the action of a tilt. Item 74—tilt arm automatically releases 62—reverse lock pin when starting a tilt.

By pulling 30—adjustable steering handle toward the operator until it locks, FIG. 2A at 31—down lock, 70—tilt cable is pushed, causing a corresponding movement in FIG. 5B, 74—tilt arm. As 74—tilt arm moves down in response, it allows 60—tilt cradle to lower, and stop when contacting 59B—forward thrust contact. When down, 60—tilt cradle is restrained by 66—grooved roller contact with 60A—tilt cradle transverse flange, whic provides a release capability if the propeller strikes an obstacle under water, and the restraint tension is adjustable by advancing 75—tilt cable sheath into FIG. 4A, 78—tilt cable sheath retainer with screw outboard.

Movement left or right of FIG. 1 30—adjustable steering handle causes a push or pull of 90—steering cable, and a corresponding motion in FIG. 4A 59—tilt housing, and thereby providing steering control of 97—outdrive steering assembly.

FIG. 1, 33—pedal and crank operation rotates 36—driver bevel gear. FIG. 3, 36—driver bevel gear is clamped between 46—idler bearing, and 37—driven bevel gear. Pedal and crank rotation are transmitted as torque through 87—driven gear bearing housing, and 80—drive cable to FIG. 4A, 68—foot with propeller assembly, passing through FIG. 5A 62—reverse lock pin which rotates slightly in the direction of the drive cable or drive shaft passing through it. When the drive cable is rotating in a forward direction, 62—reverse lock pin provides no obstruction to tilt, however when the rotation is in reverse, it seats in 59C—reverse lock slot and prevents the propeller from raising the outdrive out of the water. Another method of applying this reverse lock feature would be to use wheels or apparatus whose outer edge contacted the drive cable creating rotation/position change which could be utilized to lock the outdrive down.

I claim:

1. A manual boat propulsion driver comprising:

a portable carrying frame supporting a telescoping adjustable steering handle which remotely controls the steering of a portable remote outdrive through a first flexible sheathed push-pull cable and remotely controls the lifting and lowering of said outdrive through a second flexible sheathed push-pull cable;

said frame removably supporting an adjustable boom;

said adjustable boom including attaching means for remotely supporting said outdrive;

said frame including adjustable outriggers having mounting pads;

said frame including a mounting with a seat;

said frame including a drive mechanism having a crank assembly including pedals, each having a clip-on heel rest with a counterweight;

said drive mechanism including a large bevel gear driving an idler gear which drives a smaller bevel gear, said smaller bevel gear turns a first rotating flexible sheathed cable as to transfer operator energy to said outdrive to produce forward and reverse propeller rotation; and said drive mechanism having attachment means for a second rotating flexible sheathed cable which powers an air compressor.

2. A boat propulsion portable outdrive supported by an adjustable removable boom and controlled remotely through flexible sheathed cables, said outdrive comprising:

an outdrive frame;

a supporting foot and propeller removably attached to a tilt assembly;

said tilt assembly being mounted on a vertical inner steering tube;

said inner vertical steering tube being mounted for rotational movement within a vertical adjustment tube;

said vertical adjustment tube having vertical movement within an upper tube guide and a lower tube guide mounted on said outdrive frame;

one of said tube guides including a clamp which slides in horizontal slots, said clamp having a fastener, whereby tightening said fastener both locks said clamp in said slots setting the trim and locks said vertical adjustment tube within said clamp setting its depth, while permitting said inner vertical steering tube to rotate within said vertical adjustment tube for steering movements transmitted by one of said flexible sheathed cables;

said outdrive assembly being remotely powered by rotation of a second of said flexible sheathed cables;

said tilt assembly including a reverse lock pin which is controlled automatically by said rotation of said second flexible sheathed cable to lock said tilt assembly down in reverse operation, while permitting tilt while in forward operation; and said tilt assembly being tilted by a tilt arm which is remotely controlled by another of said flexible sheathed cables which releases said lock pin and locks said outdrive in a position tilted out of the water.

* * * * *